United States Patent [19]

Robinson, Jr.

[11] 4,421,208

[45] Dec. 20, 1983

[54] UPRIGHT FORK LIFT TRUCK

[75] Inventor: Richard H. Robinson, Jr., Kalamazoo, Mich.

[73] Assignee: Clark Equipment Company, Buchanan, Mich.

[21] Appl. No.: 232,762

[22] Filed: Feb. 9, 1981

[51] Int. Cl.[3] ..... B66B 9/20

[52] U.S. Cl. ..... 187/9 E; 414/631

[58] Field of Search ..... 187/9 E, 9 R; 414/629, 414/631, 641, 647, 635, 785; 254/89 H, 93 R

[56] References Cited

U.S. PATENT DOCUMENTS

| | | | |
|---|---|---|---|
| 2,618,360 | 11/1952 | MacDonald | 187/9 E |
| 2,788,863 | 4/1957 | Ulinski | 187/9 R |
| 2,883,003 | 4/1959 | Arnot | 187/9 E |
| 3,360,078 | 12/1967 | Hopfeld | 187/9 R |
| 3,394,778 | 7/1968 | Brinton | 187/9 E |
| 3,830,342 | 8/1974 | Allen | 187/9 R |
| 4,030,568 | 6/1977 | Heinold | 187/9 E |

FOREIGN PATENT DOCUMENTS

| | | |
|---|---|---|
| 1807169 | 9/1969 | Fed. Rep. of Germany . |
| 2020276 | 4/1970 | Fed. Rep. of Germany . |
| 2,926,657 | 1/1981 | Fed. Rep. of Germany . |
| 2053153A | 2/1981 | United Kingdom . |

OTHER PUBLICATIONS

Bartow–Patent applications (Ser. No. 202099) (Ser. No. 176342), filed Oct. 30, 1980 and Aug. 11, 1980, respectively.

*Primary Examiner*—Joseph J. Rolla
*Assistant Examiner*—Kenneth Noland
*Attorney, Agent, or Firm*—John C. Wiessler

[57] ABSTRACT

A triple-stage upright having a fixed upright section, two telescopic upright sections, and a load carrier mounted on the inner telescopic section. A first asymmetric lift cylinder assembly is located in the upright off-center and adjacent to one side of the upright and a second asymmetric lift cylinder assembly is mounted in the upright off-center and adjacent to the opposite side of the upright. Both cylinder assemblies are supported from a common base, one of the cylinders being operatively connected to the load carrier, and the other lift cylinder being operatively connected to both telescopic upright sections. The lift cylinder which is connected to the load carrier is, when collapsed, approximately one-half the height of the collapsed upright, and the other lift cylinder assembly is, when collapsed, approximately equal to the height of the collapsed upright. A unique balancing system is implemented in the combination of cylinder locations and respective reeving of lifting chains which maintains a substantial balance of force-moments in the transverse plane of the upright.

40 Claims, 18 Drawing Figures

UPRIGHT FORK LIFT TRUCK

BACKGROUND OF THE INVENTION

One of the most persistent problems encountered in the industrial truck art over the years has been to provide an upright construction which affords the operator of the truck good visibility through the upright, particularly in triple and quad-stage uprights.

Heretofore various means have been devised for improving operator visibility through multi-stage uprights of lift trucks while maintaining relatively simple and low cost construction. Previous attempts have included upright structures such as are disclosed in U.S. Pat. Nos. 2,788,863, 3,360,078, 3,394,778, 3,830,342 and 4,030,568, German Patent No. 1,807,169 and German Publication (Offlegunschrifft) No. 2,020,276. In addition U.S. patent application Ser. Nos. 202,099 and 176,742, filed Oct. 30, 1980 and Aug. 11, 1980 are now issued, respectively, which are continuations of Ser. Nos. 17,779 and 28,291, filed Mar. 8, 1979 and Apr. 9, 1979, respectively, and both abandoned and both in the name of Richard J. Bartow, common assignee, disclose prior art of interest. Also, Ser. No. 17,779 is a continuation-in-part application of Ser. No. 842,765, filed Oct. 17, 1977 and now abandoned.

SUMMARY

My invention is an improvement over any known prior upright structure for a lift truck which is designed to provide good operator visibility through the upright. My invention provides an upright structure of relative simplicity and low cost for uprights having three or more stages. I provide in such a multi-stage upright two asymmetric lift cylinder assemblies located on opposite sides of the central vertical longitudinal plane of the upright and which are independently reeved by sprocket and chain means to elevate both a load carriage and telescopic sections of the upright. Both cylinder assemblies are mounted such that they are operatively connected to different ones of the upright elements comprising the load carriage and telescopic sections in a manner which provides good visibility through the upright and which minimizes or eliminates any need for reeving of hydraulic conduits in the upright as has been required heretofore in uprights of the type contemplated in order to conduct hydraulic pressure fluid to a primary cylinder assembly which ordinarily has been elevated with the inner telescopic section during upright operation. The lifting system is designed to provide an upright assembly which is in substantial force moment equilibrium in the transverse plane of the upright.

A primary object of the invention is to provide an improved multi-stage upright structure for lift trucks in which good operator visibility is provided through the upright, and which minimizes the necessity of reeving hydraulic conduit in such upright structures.

It is an important principle of the invention to provide an essentially balanced upright which utilizes twin asymmetric cylinder assemblies for elevating different upright elements.

It is an important feature of the preferred embodiment of the invention that both asymmetric cylinder assemblies are supported from a common base.

Other objects, features and advantages of the invention will readily appear to persons skilled in the art from the detailed description of the invention which follows.

DESCRIPTION OF PREFERRED EMBODIMENT

Figure 1:
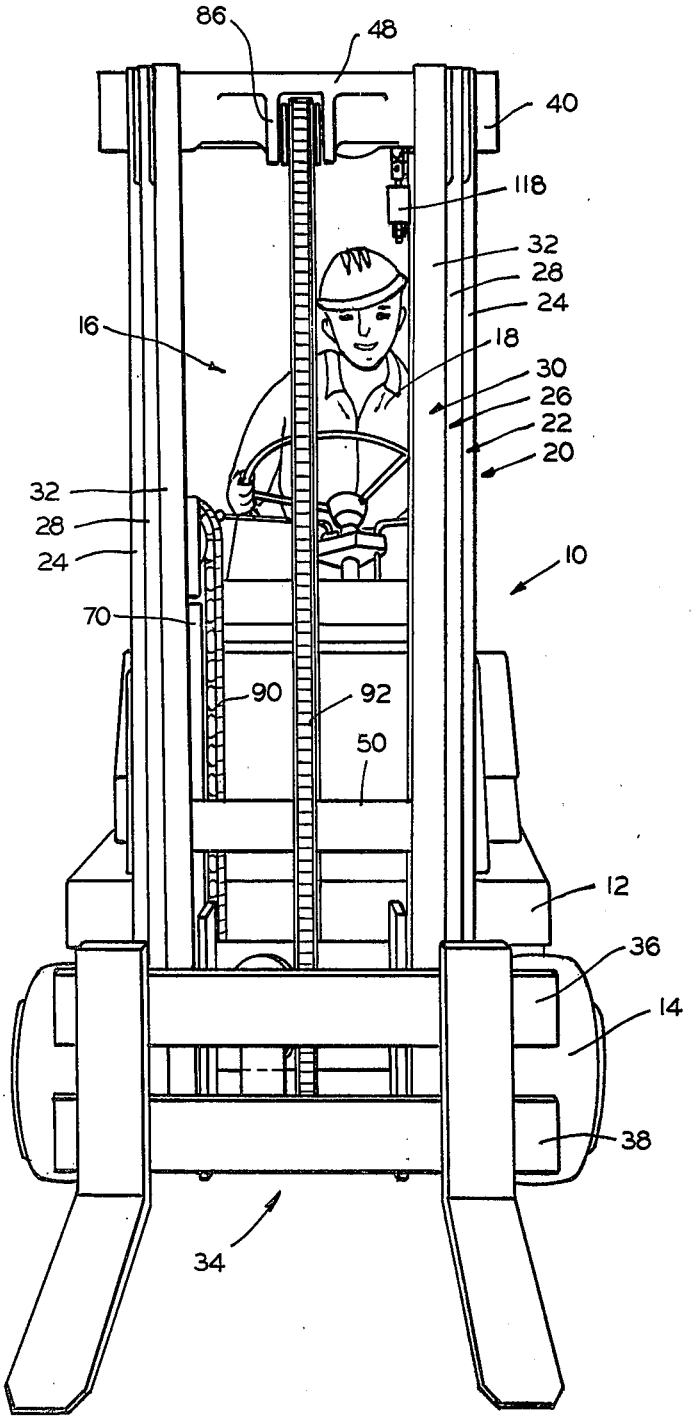
FIG. 1 is a front perspective view of an industrial lift truck which embodies the invention; it shows a load carriage lowered to the bottom of retracted telescopic upright sections of a triple-stage upright and exemplifies the improved operator visibility which is provided through the upright.

Referring to the drawing, and first to FIGS. 1–7, a conventional industrial lift truck is shown at numeral 10 having a frame and body construction 12 mounted on a pair of steer wheels, not shown, at the rear end thereof and a pair of traction wheels 14 forwardly thereof. It embodies suitable power components for operating the truck from an operator's compartment 16. An operator is illustrated in FIG. 1 at numeral 18 in a normal position and attitude as he would appear when operating the truck to an observer in front of the truck.

The upright assembly of the present invention is illustrated generally at numeral 20, the assembly being mounted on the truck in known manner. A fixed mast section 22 includes a pair of transversely spaced opposed channel members 24 arranged to receive a first telescopic mast section 26 formed of two laterally spaced I-beams 28, which is in turn arranged to receive a second telescopic mast section 30 formed of two laterally spaced I-beams 32, the mast sections 26 and 30 being guide roller supported in mast sections 22 and 26, respectively, in known manner, and arranged for longitudinal telescoping movement relative to each other. A load or fork carriage 34 having a pair of transverse support plates 36 and 38 is guide roller mounted in known manner for elevation in the upright section 30.

Mast section 22 is cross-braced for rigidity by means of upper and lower transverse brace members 40 and 42, intermediate telescopic section 26 is cross-braced by upper and lower transverse members 44 and 46, and inner telescopic mast section 30 is cross-braced by upper, intermediate and lower transverse members 48, 50 and 52.

Figure 4:
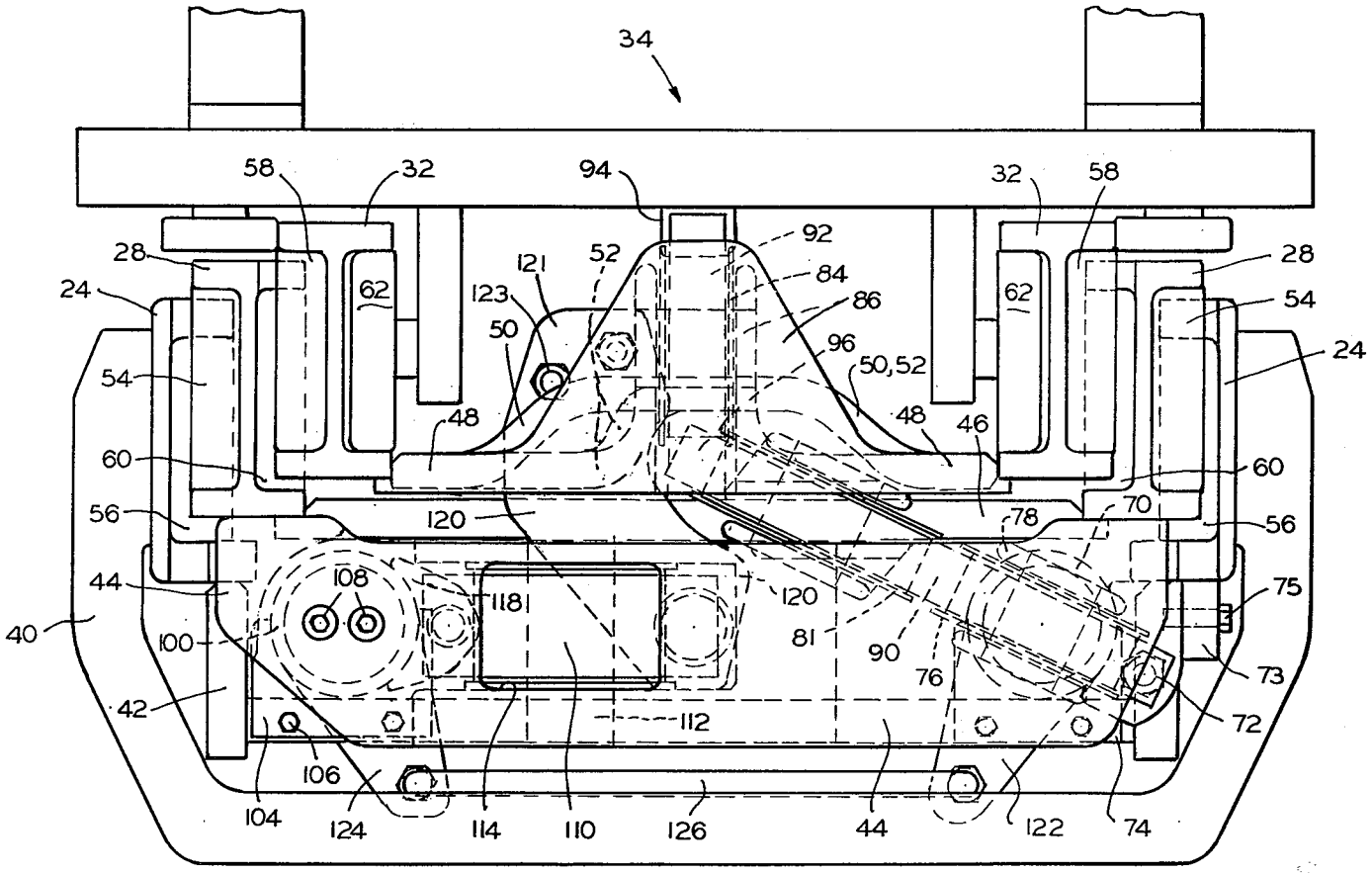
FIG. 4 is an enlarged plan view of the upright shown in FIG. 3.

The I-beam mast section 26 is nested within the outer section 22 such that the forward flanges of the I-beams 28 are disposed outside of and overlapping the forward flanges of channels 24 and the rear flanges of the I-beams are disposed inside the adjacent channel portions and forwardly of the rear flanges of channels 24, pairs of rollers being suitably mounted between said adjacent pairs of the I-beams and channels for supporting the I-beam telescopic section longitudinally and laterally for extensible movement relative to the fixed channel section. In similar manner, inner I-beam mast section 30 is nested with intermediate section 6 for extensible movement relative thereto, all in known manner. The support and guide rollers of each said pair are illustrated in FIG. 4 at 54,56 and 58,60, while the upper rollers mounting the load carriage 34 in the inwardly facing channel portions of the inner I-beam section are illustrated in FIG. 4 at 62.

A primary cantilevered asymmetric lift cylinder assembly 70 is supported adjacent one side of the upright assembly partially behind the assembly of rail sections on that side of the upright. It is supported near the upper end of the cylinder by a chain anchor block 72, which may be welded to the outside surface of the cylinder, and near the bottom of the cylinder it is supported by a bracket 74 which may be secured to the cylinder, as by welding, and which is in turn secured as by studs 75 to support brace 42. A block member 73 is welded to the adjacent flange of the one rail member 24 in position to secure anchor block 72 thereto by registrable studs 75. A single sprocket 76 is mounted by bracket 78 in known manner for rotation at the end of a piston rod 80. A second sprocket 81 is mounted in a similar bracket 82 having a base 84 straddling and secured to the surfaces of brace member 46 of intermediate mast section 26, sprockets 76 and 81 being mounted, as shown, on a bias to the transverse plane of the upright and in longitudinal rotating alignment one with the other. A third sprocket 84 is operative with sprockets 76 and 81 and is supported from upper support brace 48 of mast section 30 for rotation about a transverse axis on a stub shaft which is supported from a forwardly and laterally extending portion 86 of brace 48.

Figure 13:
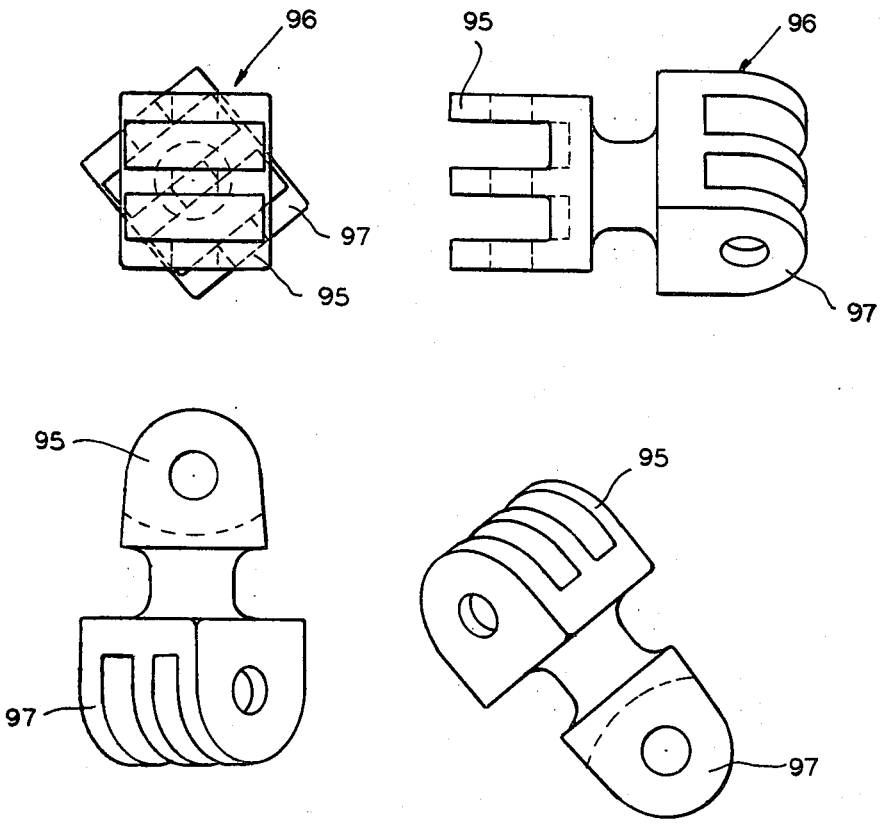
FIG. 13 comprises a group of projected views of a swivel link for use between lengths of chain in the various designs of upright structures which allows the lengths to be related to each other at any required angle.

A chain means 90,92 has its one end secured at chain anchor 72 and its opposite end secured at a chain anchor 94 on load carriage support plate 38, the chain means being reeved between the chain anchors and inside the upright assembly on sprockets 76, 81 and 84. A "twist" chain link coupling or swivel link 96, details of an exemplary design of which are shown in FIG. 13, connects the one end of chain portion 90 to the adjacent one end of chain portion 92 so that the chain portions may operate in different planes relative to the upright; i.e., chain portion 92 operates in a plane longitudinal of the upright and chain portion 90 operates in a bias plane intermediate the longitudinal and transverse planes of the upright as best shown in FIG. 4. In general, swivel or twist link 96 comprises a pair of chain link connectors 95 ad 97 related to each other at 45° in the various planes of projection, as shown, for the purpose described. Of course, depending upon design requirments the connectors 95 and 97 can be related to each other at any preselected angle.

Figure 2C:
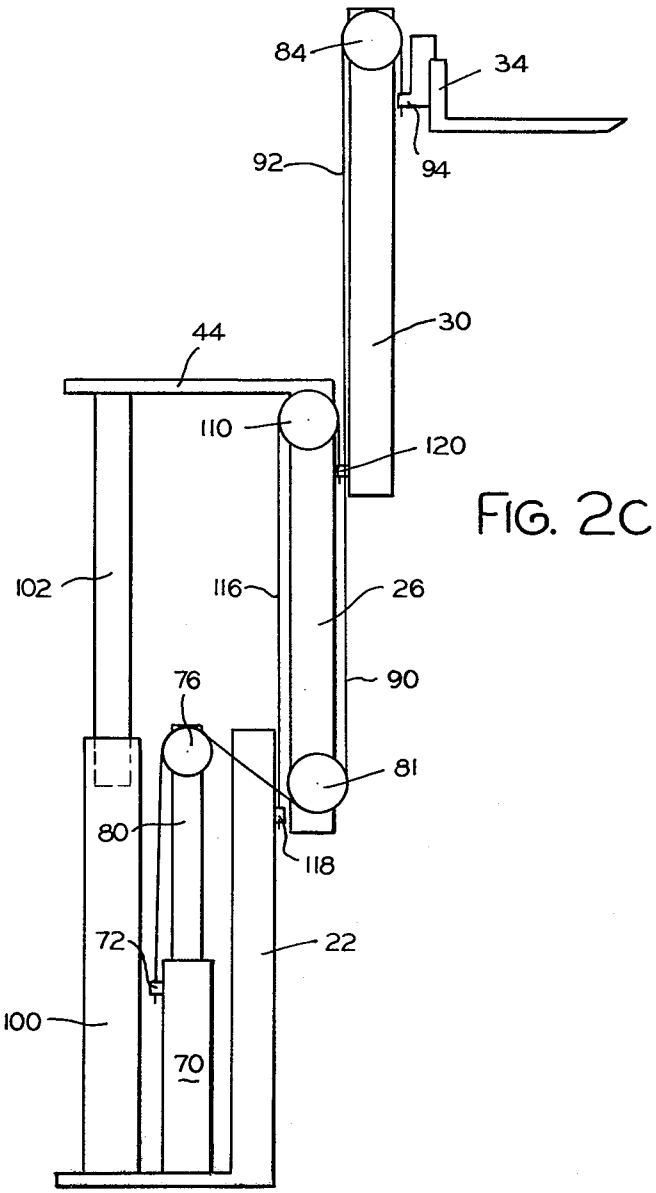
FIGS. 2A, 2B and 2C comprise a series of schematic representations of the upright in various stages of operation.
Figure 2A:
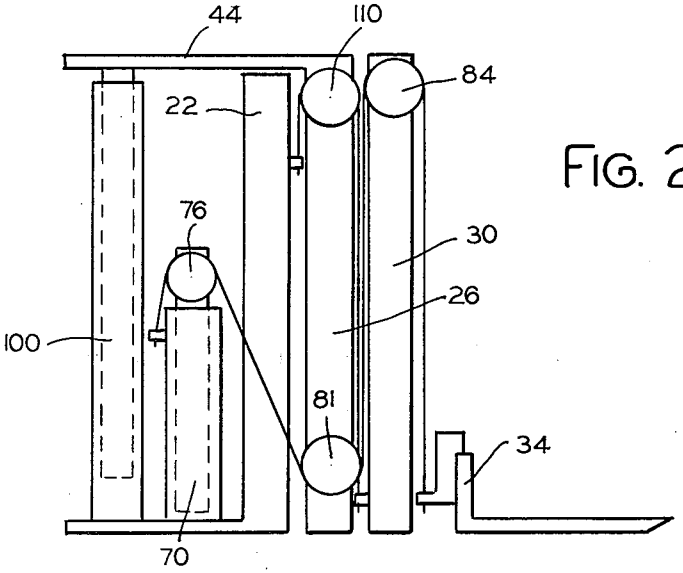
Figure 2B:
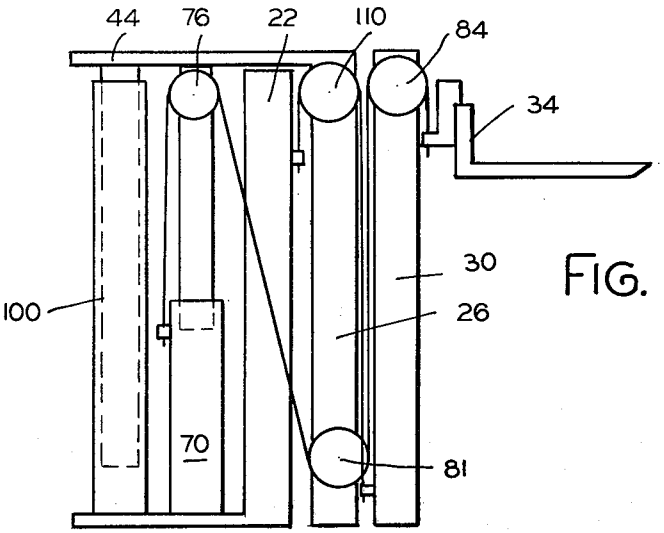
Figure 5:
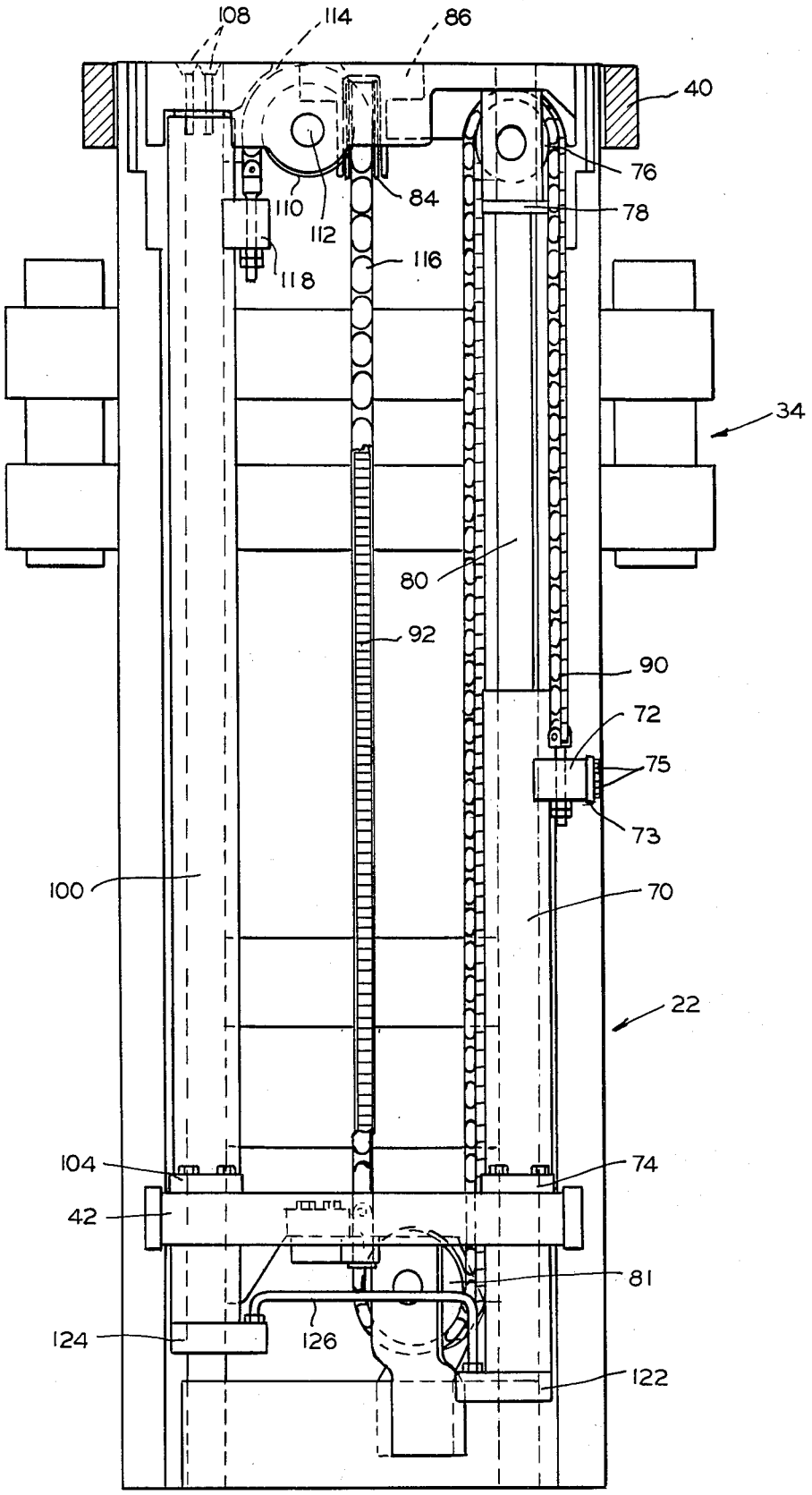
FIG. 5 is a view of the upright as in FIG. 3, but with the load carriage in a free-lift position.

The retracted height of cylinder assembly 70 is substantially one-half the collapsed height of the upright assembly 20 and is adapted to elevate load carriage 34 on upright section 30 to a nearly full free-lift position at full extension of piston rod 80, at which time bracket 78 comes into contact with intermediate upright support brace 44 as shown in FIGS. 2B and 5, or, if preferred, a suitable stop may be providded inside of cylinder 70.

A second asymmetric cylinder assembly 100 having a piston rod 102 is located at the side of the upright assembly opposite the location of cylinder assembly 70 so that preferably it also lies at least partially behind the assembled rails on that side of the upright, it being also supported adjacent its lower end from fixed upright section brace member 42 by a bracket 104 and studs 106, and supported at its upper end by the piston rod end being secured directly to support brace 44 by a pair of studs 108. A single sprocket 110 is supported for rotation on a stub shaft 112 within an opening 114 formed inside of support brace 44, the sprocket being rotatable on an axis substantially longitudinal of the lift truck, i.e., in a plane which is substantially normal to the plane of rotation of sprocket 84. A lifting chain 116 is reeved on sprocket 110 and is connected at one end to an anchor block 118 which is secured at the inside upper end portion of cylinder 100, and is connected at the other end to a rearwardly extending anchor plate 120 which is secured beneath a forwardly extending plate 121 by bolts 123. Plate 121 is secured, as by welding, to lower support brace 52 of inner upright section 30. Extension of cylinder assembly 100 follows sequentially and automatically the extension of cylinder assembly 70, assuming full extension of cylinder 70 prior to the beginning of extension of cylinder 100 if the cylinders are of the same size. This automatic sequential operation results from a greater total weight being supported by cylinder 100 than by cylinder 70, so that cylinder 70 extends first. The additional weight supported by cylinder 100 is represented primarily by upright sections 26 and 30. Base members 122 and 124 of the cylinders are connected together hydraulically by a conduit 126, the hydraulic system of the lift truck, not shown, being suitably connected and controlled by the operator to cylinder base 122.

As will be apparent to persons skilled in the art, a significant advantage of my invention over prior triple-stage upright designs is the elimination of the necessity to reeve hydraulic conduits in and on the upright for elevation therewith.

Figure 3:
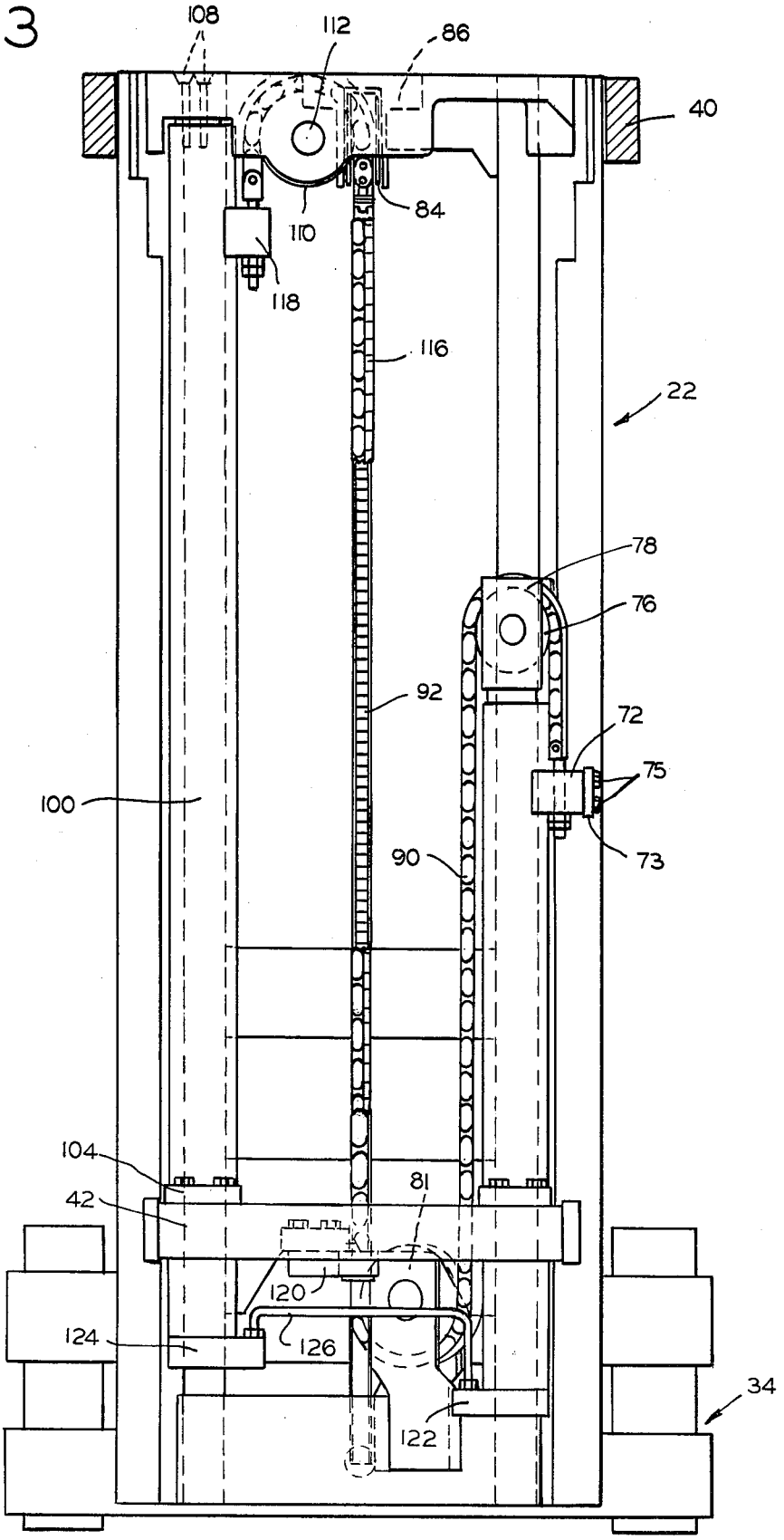
FIG. 3 is an enlarged full rear view of the upright shown in FIG. 1 with the upright dismounted from the truck.
Figure 6:
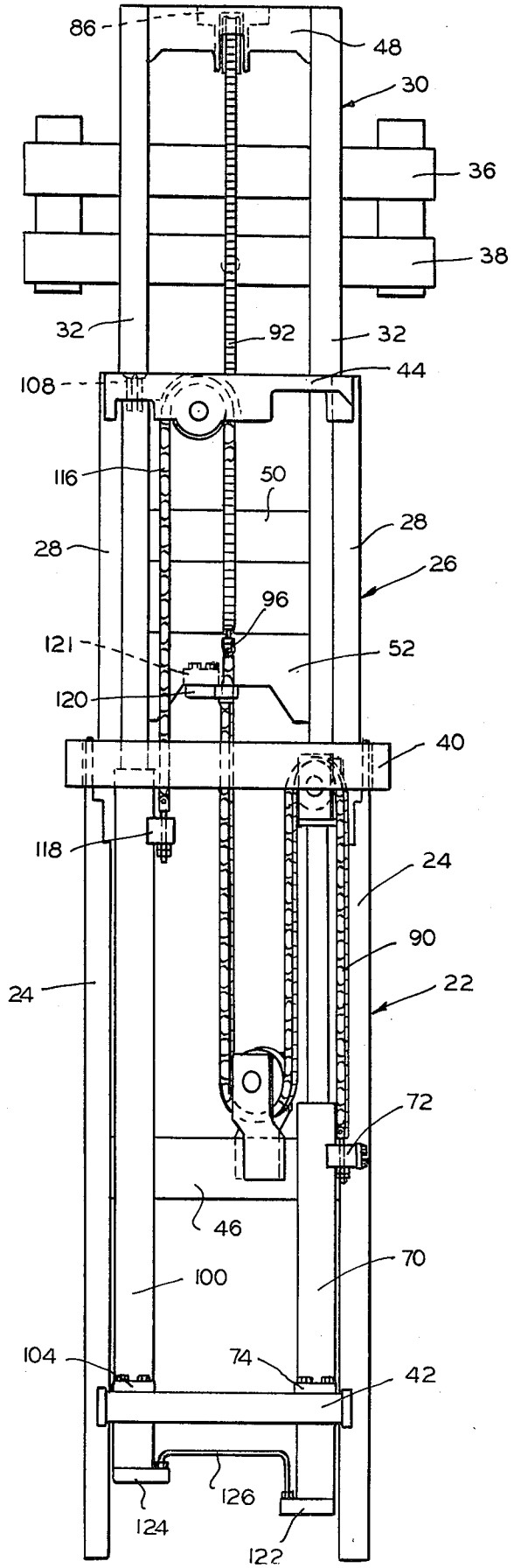
FIG. 6 is a rear view reduced in scale showing the upright partially extended.
Figure 7:
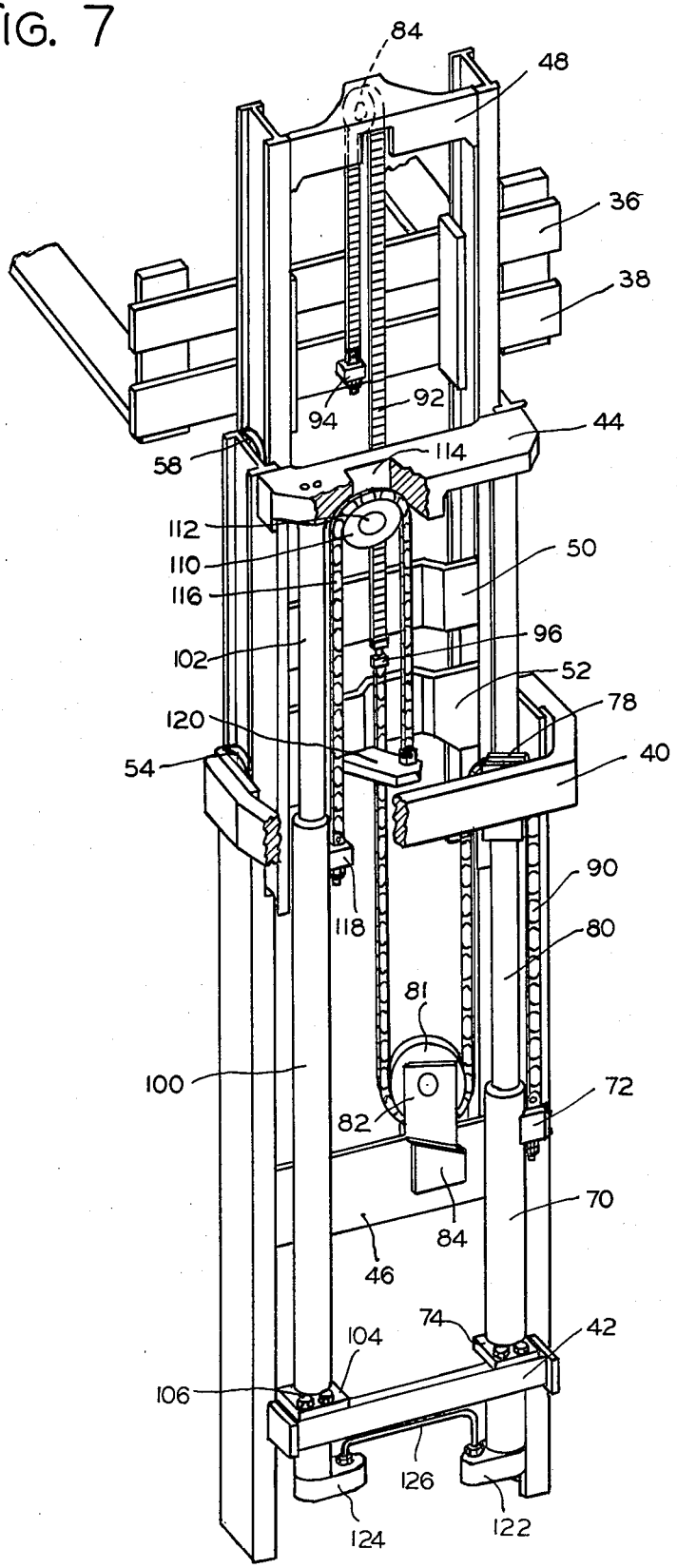
FIG. 7 is a partially cut-away rear perspective view of the upright as shown in FIG. 6.

It will be observed that the upright design is such that at any given stage of extension or retraction thereof the interior or central vertical portions of chains 90, 92 and 116 are at all times located in substantial alignment one with another in substantially the central vertical longitudinal plane of the upright, thereby minimizing interference with operator visibility through the upright by such interior chain portions substantially to the width of the widest single chain, as seen, for example, in FIGS. 1, 3 and 6. It will also now be apparent to persons skilled in the art that contrary to prior triple-stage uprights utilizing a separate centrally located primary cylinder assembly, my invention relocates that cylinder at one side of the upright, thereby substantially improving the visibility through the upright. It will be appreciated that in operation the load carriage is elevated at a 2:1 movement ratio to its free-lift position (FIG. 5) by primary cylinder assembly 70, and then the sequential operation of cylinder assembly 100 occurs to elevate the load carriage with inner mast section 30 to full extension at a 2:1 movement ratio to the cylinder assembly and to intermediate section 26 (partial extension thereof is illustrated in FIGS. 6 and 7).

The location of cylinder assembly 70 behind or at least partially behind the rail sections on the one side of the upright is in part able to be effected by the use of the twist coupling 96 between chain portions 90 and 92 thereby enabling a change in direction of the chain reeving from the location of chain 90 in the aforementioned intermediate or biased plane to the location of chain 92 in the central longitudinal plane of the upright. It will also be noted that the portion of the chain which includes the coupling 96 is not required to pass over any sprocket so that it does not interfere with a smooth and continuous lifting operation.

References made in the specification and claims hereof to the longitudinal plane of one side of the upright, or of a transverse plane or the transverse planes of the upright, or terms of similar import, shall have the following meanings:

The longitudinal plane of one side of the upright shall mean a three-dimensional vertical plane extending longitudinally of the upright assembly bounded by the outer and inner surfaces of the vertical rail assembly on one side of the upright, while a transverse plane or planes of the upright shall mean any two-dimensional vertical plane extending transversely of the upright assembly in the area bounded by the front and rear surfaces of the vertical rail assemblies of the upright comprising the assembled upright sections.

In order to substantially balance the force-moments in a transverse plane of the upright the location of sprockets 76 and 81 must be such that the vertical axis of the portion of lift chain 90 reeved between said sprockets is located at a transverse distance from the central vertical longitudinal plane of the upright which is approximately equal to twice the transverse distance between the axis of lift cylinder 100 and the location of chain anchor 118. The vertical axis of cylinder 70 is then located the same distance from said central vertical longitudinal plane of the upright as is the vertical axis of cylinder 100, but on the opposite side of the upright. Chain 116 is connected at the transverse center of inner rail section 30 and may be connected at the other end to either the adjacent outer rail member 24 or to a member which is attached to rail member 24, such as to the lift cylinder barrel of cylinder 100 as shown at 118, but in all events at a transverse location which permits the sprocket 81 to be located as required above and which satisfies any other design requirements.

The actual locations in the transverse plane of the upright of the lift cylinders and chains may be modified somewhat to account for the force-moment effect of the dead weight of the components if the force-moment equilibrium is to include such weight effects in a given design. So long as the conditions set forth above are met, cylinder 70 may be located to meet other upright design criteria, preferably out of the operator's visibility window. The specific location of cylinder 70 will be a function of the force-moment balance only if the weight effect of rail sections 26 and 30 and of the cylinders 70 and 100 are accounted for.

Figure 8D:
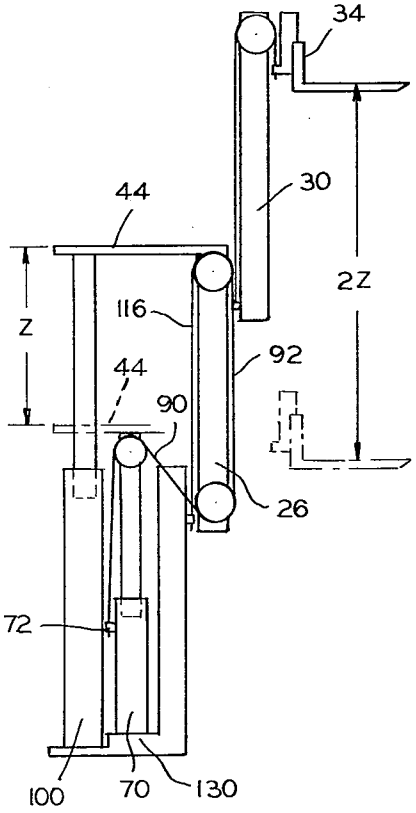
FIGS. 8A, 8B, 8C and 8D comprise schematic views of a modification of the upright.
Figure 8C:
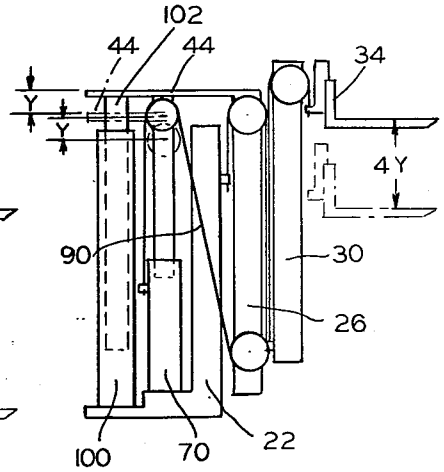
Figure 8B:
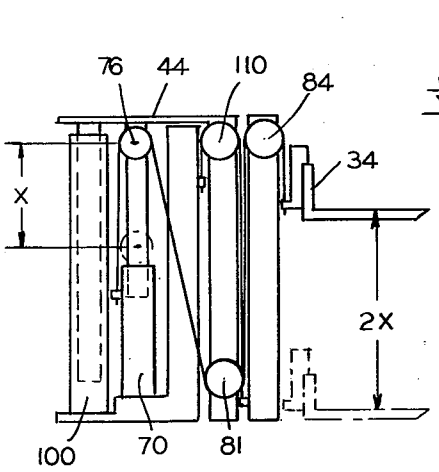
Figure 8A:
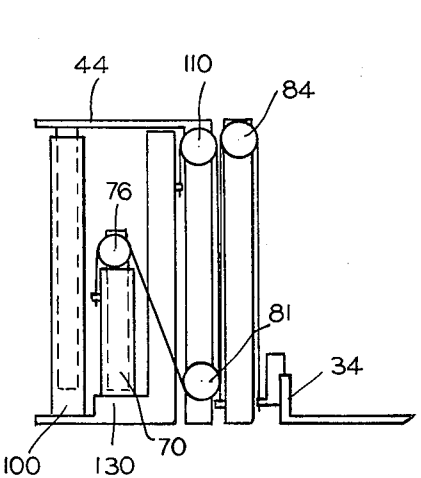

In certain lift truck designs it may be required that primary cylinder 70 be located at a higher elevation in the upright than is shown in FIGS. 1–7 in order that, for example, certain lift truck components such as an offset differential housing of the front drive axle assembly will not interfere with the cylinder mounting. I have found that it is possible to utilize the same basic construction as is shown in the embodiment of FIGS. 1–7 with cylinder assembly 70 mounted from a somewhat elevated position adjacent the one side of the upright to clear the differential housing. This results in a smaller available free-lift of the load carriage than is shown in FIGS. 1–7. In such a modification, which is represented herein schematically in FIGS. 8A–8D, a portion of the lifting sequence is effected by cylinder assemblies 70 and 100 acting simultaneously on the support brace 44 of upright section 26, cylinder 70 being of the same collapsed height in FIG. 8A as in FIG. 1. The entire upright construction, as schematically represented in FIGS. 8A–8D, may be the same as in FIGS. 1–7 except that cylinder assembly 70 is mounted from the one side of the upright at a somewhat elevated position as represented by the platform at 130. The distance indicated at $2x$ in FIG. 8B represents the distance of free-lift during which cylinder 70 extends distance x while elevating carriage 34 at a 2:1 ratio, the telescopic upright sections remaining fully retracted. The distances indicated at y,y in FIG. 8C represent the effective vertical distances travelled by cylinders 70 and 100 operating simultaneously in the transition from FIG. 8B to FIG. 8C to simultaneously elevate both load cariage 34 and upright section 30. In this "dual lift" transition the axis of sprocket 76 of cylinder 70 travels a distance of y at a 1:4 travel ratio in elevating carriage 34 while cylinder rod 102 travels the distance y at a 1:4 travel ratio to carriage 34 and elevates upright section 26 at a 1:1 ratio, all as represented in FIGS. 8B and 8C. It wll be understood that such simultaneous operation of cylinders 70 and 100 functions to elevate the load carriage through distance $4y$ on upright section 30 while elevating both upright sections 30 and 26 from a fully retracted position, all as shown in FIGS. 8B and 8C. Subsequent to such simultaneous operation, cylinder 100 continues to elevate the upright to full extension as shown in FIG. 8D at a 2:1 travel ratio as between the load carriage and cylinder 100 with the load carriage maintained at its maximum height position relative to upright section 30.

There is no observable effect on the smooth and continuous operation of the upright components during such simultaneous operation of both cylinders. The result is that an overall 4:1 lifting ratio of the load carriage relative to cylinder stroke is effected, but since the fluid flow rate to the cylinders is constant with a fixed pump capacity, the flow rate to each cylinder will be one-half the flow rate available when only one cylinder is extending. Thus, when both cylinders lift simultaneously as aforesaid, the net lifting speed of the load carriage is the same as in the embodiment of FIGS. 1–7, and a smooth, continuous lifting operation is effected from ground level of the load carriage to maximum fork height.

Figure 9:
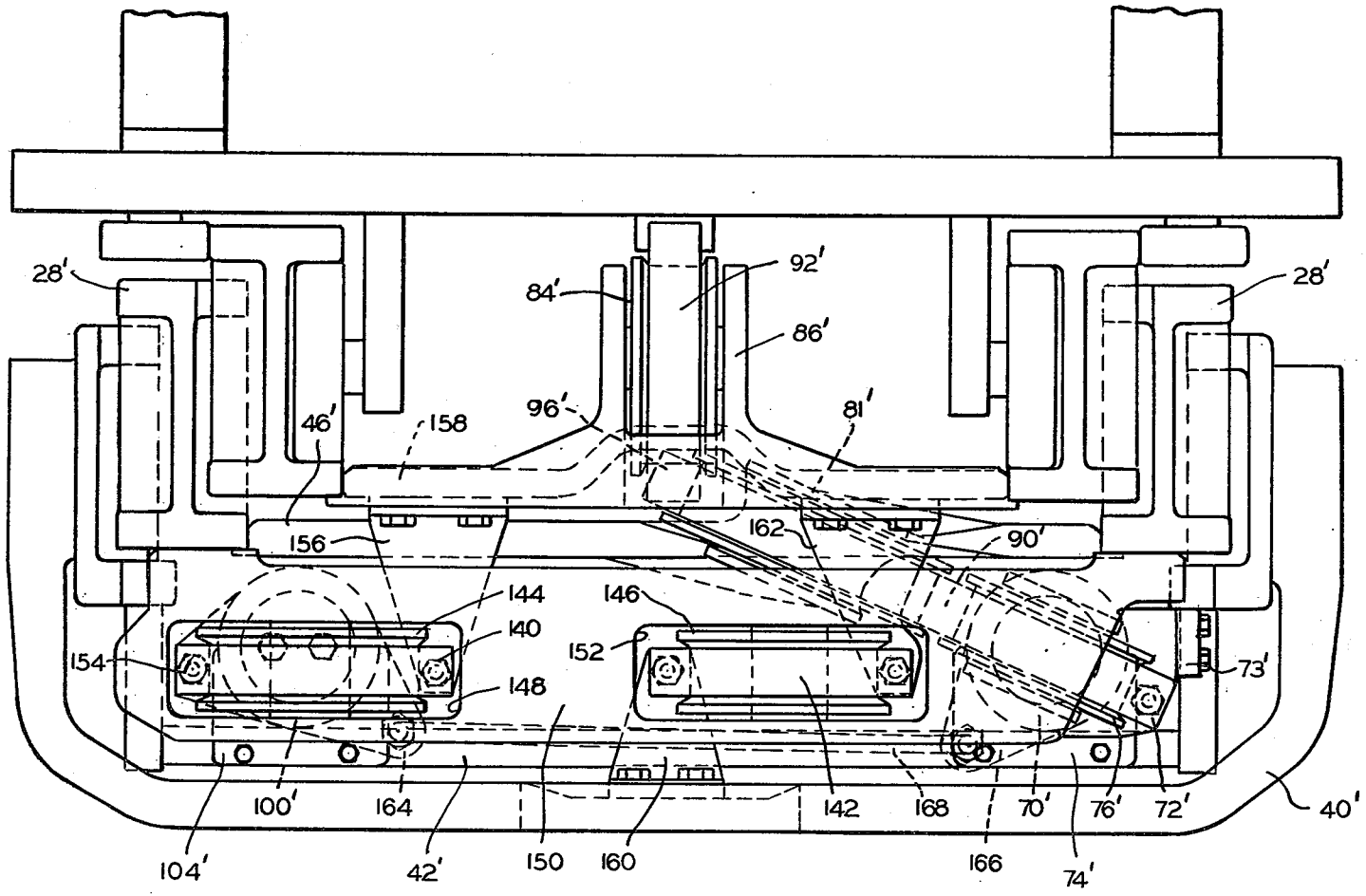
FIG. 9 is a plan view of the upright which shows another modification of the structure shown in FIGS. 1–7.
Figure 10:
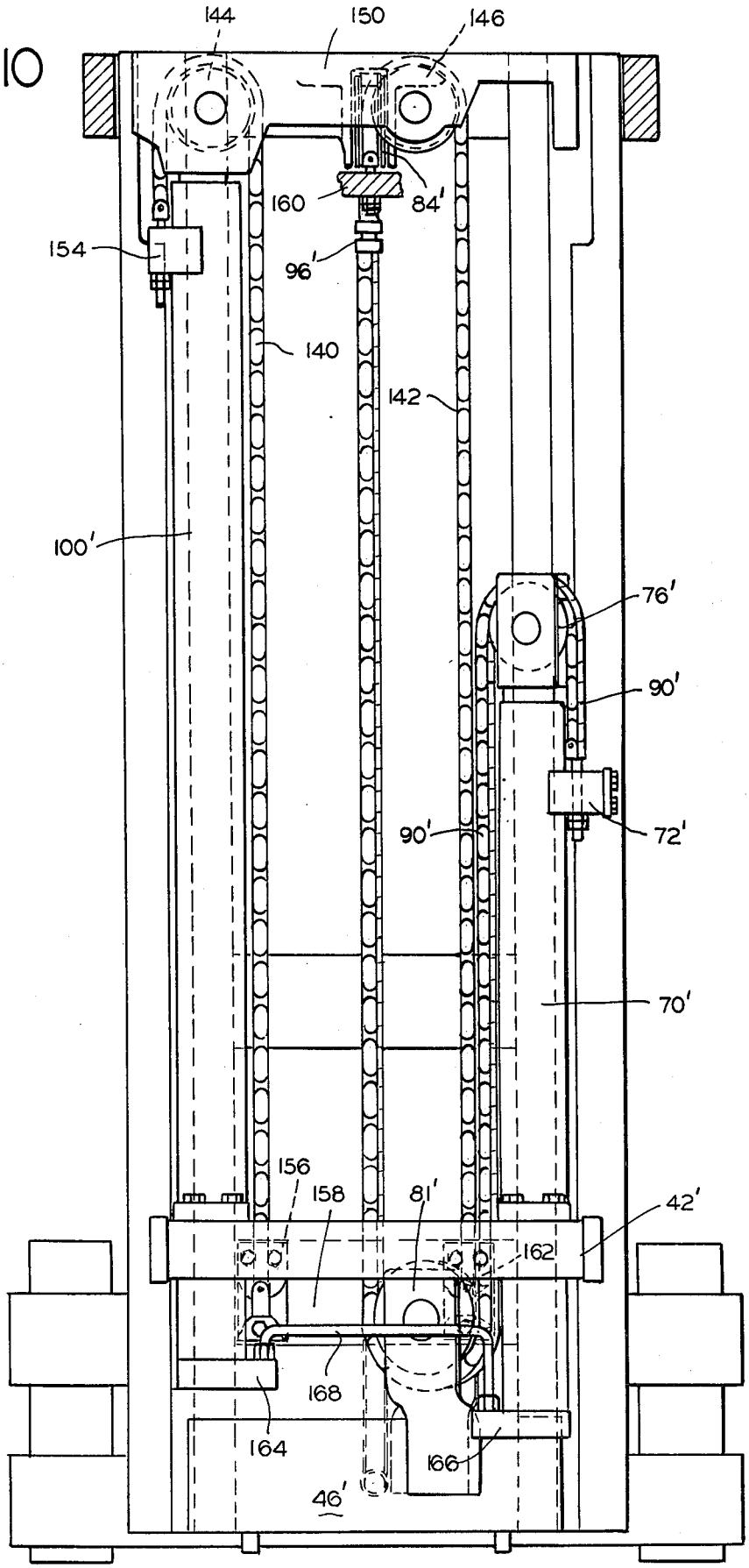
FIG. 10 is a collapsed rear elevational view of the upright of FIG. 9.

Referring now to the modification shown in FIGS. 9 and 10 the structure as disclosed is similar to the structure of the embodiment of FIGS. 1–7 except primarily in the manner of secondary chain reeving. Similar parts have been numbered the same as in FIGS. 1–7, but as prime numbers. Secondary chain 116 and sprocket 110 of FIGS. 1–7 are replaced in FIGS. 9 and 10 by a pair of chains 140 and 142 reeved independently on a pair of sprockets 144 and 146.

Sprocket 144 is mounted on a stub shaft and in an opening 148 of upper brace member 150 of the rails 28' of rail section 26 and sprocket 146 is similarly mounted in a second opening 152 which is spaced transversely of opening 148. Chain 140 is secured at its outer end at an anchor bracket 154 which is secured to the cylinder barrel of cylinder 100' and at its opposite end to an anchor plate 156 which extends rearwardly from and is secured to lower inner upright section brace member 158. Chain 142 is secured at its one end to an anchor plate 160 which extends forwardly from the center section of upper brace member 40' of the outer fixed upright section and which is secured thereto, the opposite end of said chain being secured to an anchor plate 162 which extends rearwardly from and is connected to brace member 158. The chains 140 and 142 operate together to elevate the inner upright section upon extension or retraction of cylinder 100' inasmuch as the chains are effectively connected at their one ends to fixed elements of the upright assembly. The vertical run of chain 142 secured to anchor plate 160 is preferably centrally located in the upright and in the longitudinal plane of chain 92'. The cylinder bases 164 and 166 are interconnected by a conduit 168.

In order to substantially balance the force-moments in a transverse plane of the upright assembly of FIGS. 9 and 10, the connection of chain sheave 81' to the lower brace member 46' of the intermediate section 26' must be such that the vertical axis of the portion of lift chain 90' reeved between the top sheave 76' and the bottom sheave 81' is spaced at a transverse distance from the central vertical longitudinal plane of the upright which is approximately equal to twice the projected or transverse distance between the vertical axis of the secondary lift cylinder 100' and the average of the sum of the projected or transverse distances thereof from the effective anchor points of chain anchors 160 and 154. Also, the lift chains 140 and 142 must be connected to the inner upright section 30 as by anchor plates such as shown at 156 and 162 at projected or transversely symmetrical locations relative to the central vertical longitudinal plane of the upright and be also connected at their other ends to the outer upright section 22', or to a member which is attached to section 22' such as is chain 140 at cylinder 100' (at anchor 154), at transverse or projected locations which permit the chain sprocket 81' to be located as required above and which satisfy any other design requirements of any particular upright design.

The actual locations in the upright of the lift cylinders and chains may be altered slightly to account for the force-moment effect of the dead weight of the components if force-moment equilibrium is to include weight effects in a given design. So long as the above primary design conditions are met the primary lift cylinder 70' may be located as the design requires, preferably out of the visibility window of the upright, and its specific location will be a function of the force-moment balance only if the weight effects of the upright sections 22', 26' and 30' and of the cylinders 70' and 100' are taken into account.

Figure 11:
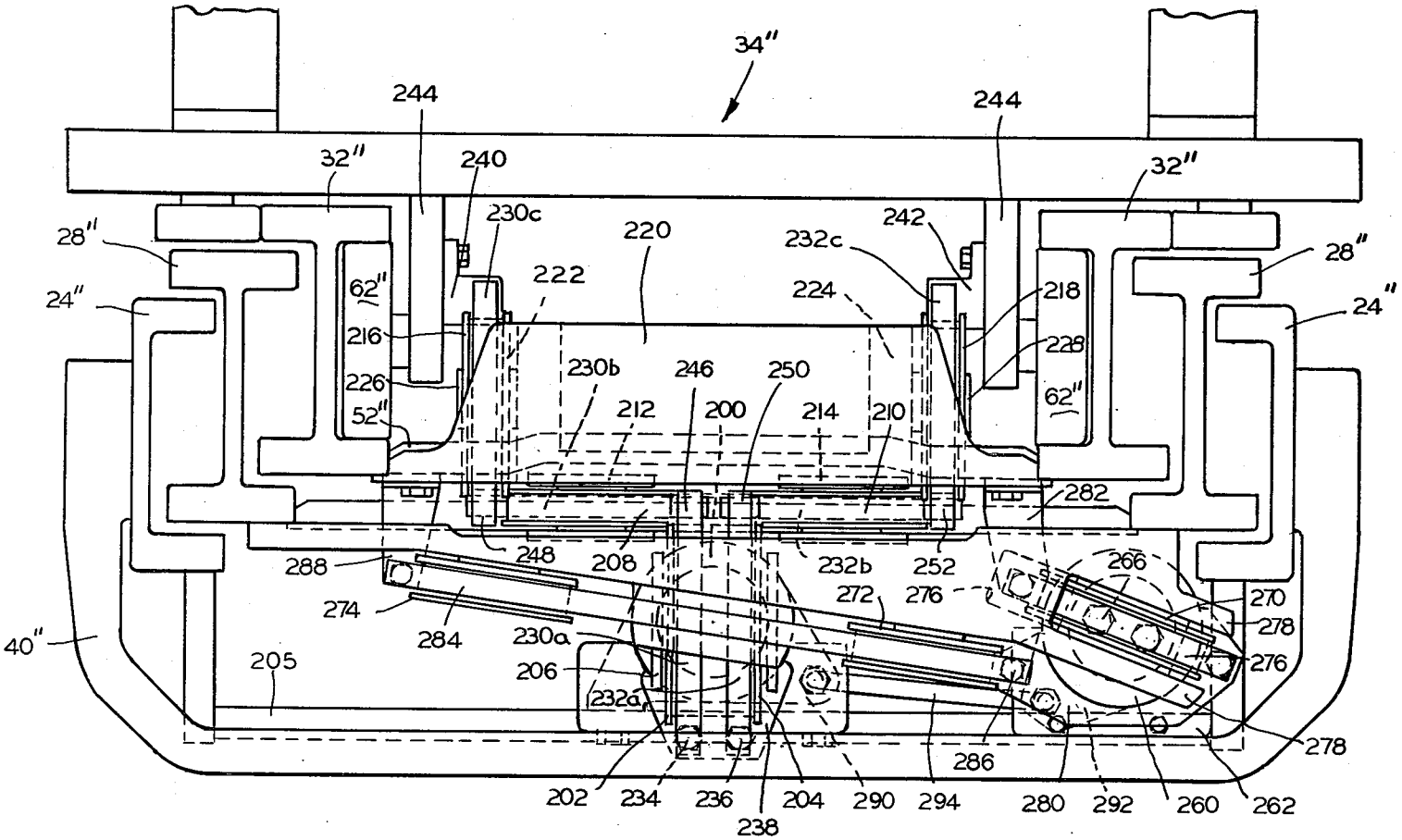
FIG. 11 is a plan view of the upright which shows another modification of the structure shown in FIGS. 1–7.
Figure 12:
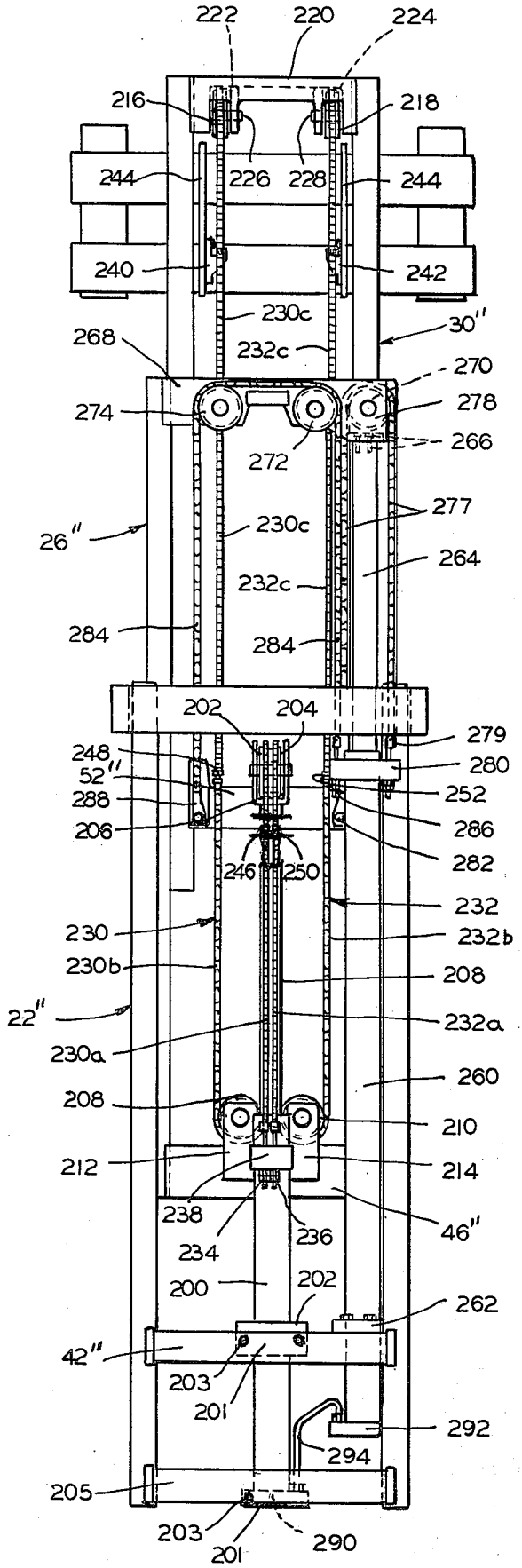
FIG. 12 is a rear elevational view of the upright of FIG. 11 partially extended.

Referring now to the modification shown in FIGS. 11 and 12, the structure at disclosed is similar to the structure of the embodiments shown in FIGS. 1–7 and 9–10 except primarily in the manner of both primary and secondary chain reeving and in the location of the secondary cylinder assembly. Similar parts have been numbered the same as in FIGS. 1–7 and 9–10, but as double prime numbers. This modification differs from the prior embodiments in that the primary cylinder is located in the center of the upright while remaining supported from the outer upright section. Two chains are used to lift the load carriage and two twist couplings are used in each chain while reeving them rearward to the primary cylinder. The secondary lift is also accomplished by two chains, the secondary cylinder being located asymmetric of the upright assembly and out of the visibility window.

Referring now in detail to the latter figures, a primary cylinder 200 is centered in the upright and is supported from primary rails 24'' by brackets and studs 201 and 203 centrally of lower transverse fixed braces 42'' and 205. Cylinder 200 is operatively connected to load carriage 34'' by means of a chain and sprocket reeving system which includes a pair of crosshead mounted double sprocket 202,204 mounted for rotation on an axis transverse of the upright in a suitable bracket 206 from the top of a piston rod 208. A second pair of sprockets 208 and 210 are mounted for rotation from brackets 212 and 214 which are supported from lower transverse brace 46'' of intermediate rails 28'' about longitudinal axes located symmetrically on opposite sides of the central vertical plane of the upright, a third pair of sprockets 216 and 218 being mounted from a top transverse brace 220 in openings 222 and 224 therein for receiving the sprockets on stub shafts 226 and 228. A pair of chains 230 and 232 are reeved symmetrically and in substantially allochiral relation on opposite sides of the central vertical longitudinal plane of the upright, the chains being reeved on opposing ones of the above mentioned sets of sprockets from anchors 234 and 236 on cylinder collar 238 to anchor members 240 and 242 on a pair of lift brackets 244,244 which mounts the load carriage from load guide rollers 62''.

Chain 230 is constructed of three chain segments **230*a*, 230*b* and 230*c* connected together at right angles as best shown in FIG. 12 by means of 90° twist link couplings 246 and 248 similar to those shown in FIG. 13 but comprising 90° twist link couplings instead of the 45° couplings shown in FIG. 13. Likewise, chain 232 is comprised of chain portions 232*a*, 232*b* and 232*c* connected also by 90° twist link couplings 250 and 252, thus enabling the sprocket and chain reeving system to be organized as shown in FIGS. 11 and 12 providing an operator's visibility window above the one-half length cylinder assembly 200 and also providing good visibility between the chain portions as best seen in FIG. 12**.

The secondary cylinder assembly 260 is also supported from the transverse brace 42'' by a bracket and studs 262 near the lower end and at upper end of a piston rod 264 connected by a bracket and studs 266 to an upper transverse brace 268 connected between rails 28'' of intermediate section 26''. Three sprockets 270, 272 and 274 are mounted each on a stub shaft in cavities formed in brace 268 in a predetermined spaced relation to each other. Sprocket 270 is mounted partially in a cavity 276 of the brace member and between bifurcated legs 278 of the brace member at a first angle biased to the transverse plane of the upright as seen in FIG. 11, whereas sprockets 272 and 274 are mounted at a second biased angle to the transverse plane of the upright. A first chain 277 of the secondary chain system is secured at its outer end by an anchor bolt 279 to an anchor block 280 mounted from the upper end of the cylinder assembly and at its opposite end is secured by an anchor 282 to a lower transverse brace member 52'', a second secondary chain 284 being reeved on sprockets 272 and 274 and secured to anchor block 280 at its one end by an anchor bolt 286 and at its opposite end to transverse brace 52'' by an anchor member 288, the anchors 279, 282, 286 and 288 being spaced in relation one to the other and to the central vertical plane of the upright as will be explained below.

Substantial force-moment equilibrium in a transverse plane of this upright assembly requires certain relationships as follows:

(1) the primary lift components, i.e., lift cylinder 200, lift chains 230 and 232, and double sprocket 202,204, and sprockets 208 and 210, and 216 and 218, must be symmetrically located in relation to the central vertical plane of the upright;

(2) the location of anchors 282 and 288 of the lifting chains 277 and 284 in the transverse plane of the upright must be also symmetrical about the central vertical plane of the upright; and (3) the lifting chain 277 must be anchored to the adjacent outer rail 24 or to a member which is fixed to the outer rail, such as the barrel of lift cylinder 260, so that the vertical axis of cylinder 260 is located in a direction transverse of the upright at a distance from the central vertical plane thereof which is equal to one-half of the sum of the projected or transverse distances from the central vertical plane to the anchor points 279 and 286.

These relationships do not precisely account for the effects of dead weights of the upright members, but they may be altered somewhat if, in a given upright design, force-moment balance which accounts for dead weight effects is desired.

In the operation of the various embodiments of my invention as disclosed herein pressure fluid is delivered by the hydraulic system simultaneously to the primary and secondary cylinder assemblies of each embodiment and, as is known, the cylinders will in each case operate automatically in a sequence related to the loads supported thereby, whereby the primary cylinder functions initially to elevate the load carriage in the inner upright section to its maximum free-lift position at a 2:1 ratio to the movement of the piston rod of the primary cylinder, except for a portion of such movement in the case of the embodiment of FIGS. 8A–8D as described previously herein. At the end of this initial stage of operation the pressure fluid automatically sequences the secondary asymmetric cylinder in each embodiment to elevate the entire telescopic upright structure in outer upright sections 22, 22' and 22'' while the load carriage is maintained by the primary cylinder in the aforementioned free-lift positon; i.e., the direct connection of the secondary cylinder assembly to the intermediate upright sections 26, 26' or 26'' in the various embodiments effects an elevation thereof in the outer upright section and simultaneously effects through the sprocket and chain reeving of each embodiment to the inner upright sections 30, 30' or 30'' an elevation of the inner section at a 2:1 movement ratio relative to intermediate upright sections 26, 26' or 26'' through the partial upright elevations shown, for example, in FIGS. 6 and 12 to positions of maximum elevation (FIG. 8D in the FIG. 8 embodiment) if the operator continues to maintain the supply of pressure fluid from the hydraulic system. Lowering of the upright is effected by venting the fluid to the fluid reservoir, whereby a reversal of the above-mentioned sequences occur as the secondary cylinder assembly in each embodiment first fully retracts to the collapsed positions of the upright assemblies, subsequent to which the primary cylinder retracts the load carrier to its lowermost position.

In each of the embodiments it will be noted that the sole hydraulic conduit connecting the primary and secondary cylinders comprises the short, fixed and rigid conduit tubing as shown, for example, at numeral 126 in FIG. 6 (also applicable to FIG. 8), numeral 168 in FIG. 10, and at numeral 294 in FIG. 12. Thus, elimination of complex movable hose and sheave reeving inside of or associated with prior multi-stage uprights of three or more sections is made possible and comprises a major improvement in the art. Another improvement resulting from such conduit design is that it essentially eliminates the prior practice of providing oversized primary cylinder design, which practice developed so as to insure the correct order of staging of the upright sections. Misstaging could otherwise occur with the fork empty as a result of a relatively large pressure drop between the cylinders because of the relatively long conduits between the cylinders. To enable this result the extremely novel use of twin asymmetric cylinder assemblies having common or fixed bases and connected to different upright lifting components has been utilized, as disclosed in the various representative embodiments herein.

It will be understood by persons skilled in the art that many design variations in upright designs than those identified and described herein may be found to be feasible without departing from the scope of my invention.

For example, although the basic design of the upright which is disclosed in all embodiments herein as being of the offset I-beam roller mounted design is preferred because of the space provided behind the rear flange or flanges of the I-beam vertical rails for partial nesting of the asymmetric cylinders therein, as best seen in FIGS. 4, 9 and 11, among other reasons, it will be appreciated that the invention may be also used with other known upright designs, including co-planar (not offset) upright sections having roller mounted channels or I-beams, or fully nested roller mounted I-beams inside of outer channels, and the like.

The location of the fixed chain anchors (shown at numerals 72 and 118 in FIG. 6, also applicable to FIG. 8 at 72', to FIG. 10 at 154, and at numerals 279, 286, 234 and 236 in FIG. 12) may, of course, be varied in different upright designs as desired, such as at different selected vertical locations on the respective cylinder barrels, or in the case of an upright mounted from certain types of lift trucks without provision for fore and aft tilting thereof, the anchors can be located on the truck frame. In the latter design it may be feasible to mount the bottom of the asymmetric cylinder assemblies also from the truck frame instead of directly from the bottom of the fixed upright section.

Depending upon such factors as the axial distance of the operator from the upright, or the transverse position of the operator when seated or standing in a normal operating position on different lift truck types, the most desirable precise locations of the asymmetric cylinder assemblies based upon the various factors will be established, many of the major ones of which are discussed above. As noted previously the most critical combination of factors affecting the selection of cylinder locations is operator visibility and force-moment balance in transverse planes of the upright, both of which may be compromised from the ideal within the scope of my invention as required to effect the most desirable combination. In this connection, it will be understood that the asymmetric cylinder assemblies may in different sizes and designs of uprights desirably project partially into both the longitudinal and transverse planes of both sides of the upright, as in fact is the case in the embodiments as best shown in the plan views in FIGS. 4 and 9 wherein the asymmetric cylinder assemblies project respectively into both such planes on both sides of the upright. In FIG. 11 the primary cylinder is centrally located so that only the secondary cylinder projects into both such planes of the one side of the upright. In other designs such cylinder assemblies may project into one only or none of such planes on one or both sides of the upright.

Before the particulars of any given upright design are finalized, including its relationship to the normal operator's position in driving the truck, it is important that within the universe of available design variations, only a few of which are disclosed herein, that the asymmetric cylinder assemblies be located such that at least the secondary lift cylinder assembly projects at least partially, and preferably substantially, into the area of interference by the adjacent side of the upright when in a retracted or collapsed position with the visibility of the operator from his normal line of sight through that side of the upright.

The designer of uprights of various widths, depths, seat locations, and the like may choose any one of a number of viable combinations of structure within the scope of my invention. It should be therefore understood that recitations in the claims thereof relating to the substantial or approximate balance of force-moments in the upright, or to the asymmetric position of a cylinder or cylinders shall be interpreted to include a range of positions of the cylinder or cylinders which best effects the desired result of good operator visibility through the upright and adequately balance force-moments acting on the upright.

The design is such that the location of the cylinder assemblies at opposite sides of the upright combines with the location of the operator to provide a normal line of sight through the upright at a predetermined designed operator's position and attitude for normal operation of the lift truck so that the cylinder assembly or assemblies at one or both sides of the upright interferes a relatively small amount or not at all with the operator's visibility through the respective side of the upright. In other words, the cylinder assembly or assemblies project at least partially into the area or areas of interference by the adjacent side or sides of the upright when in a retracted or collapsed position with the visibility of the operator from his normal line of sight through the respective side of the upright.

In a relatively wide upright, for example, and with the operator located relatively close to the upright in a forward direction it may be found advantageous to locate the two asymmetric cylinders further forwardly than is shown in certain embodiments thereby necessitating also a relocation of the cylinders transversely inwardly of the upright and out of the longitudinal plane of the respective sides of the upright.

Although I have illustrated only a few embodiments of my invention, it will be understood by those skilled in the art that many modifications, such as are discussed above, may be made in the structure, form, and relative arrangement of parts without departing from the spirit and scope of the invention. Accordingly, I intend to cover by the appended claims all such modifications which properly fall within the scope of my invention.

I claim:

1. An upright structure for lift trucks and the like having a fixed upright section, a first telescopic upright section mounted for elevation relative to said fixed section, a second telescopic upright section mounted for elevation relative to said first telescopic section and elevatable load carrier means mounted for elevation relative to said second telescopic section, the improvement comprising a first lift cylinder means secured to support means, a second lift cylinder means secured to said support means, first flexible lifting means operatively connecting said first cylinder means to said load carrier means for elevating said load carrier means on said second telescopic upright section independently of said second cylinder means, and second flexible lifting means operatively connecting said second cylinder means to one of said telescopic upright sections, said second cylinder means and second flexible lifting means being operatively connected in the upright structure to elevate said first and second telescopic upright sections.

2. An upright structure for lift trucks and the like having a fixed upright section, a plurality of telescopic upright sections mounted from said fixed section for simultaneous elevation relative to each other and to said fixed section and load carrier means mounted from one of said telescopic sections for elevation relative to said fixed and telescopic sections, the improvement comprising a first lift cylinder means secured to support means adjacent one side of the upright, and a second lift cylinder means secured to said support means adjacent the opposite side of the upright, said first cylinder means being operatively connected to said load carrier means and said second cylinder means being independently operatively connected to said plurality of telescopic upright sections.

3. An upright structure as claimed in claims 1 or 2 wherein a fixed position conduit means connects together the base ends of said first and second lift cylinder means, it being located in the lower portion of the upright structure.

4. An upright structure as claimed in claim 3 wherein said conduit means is of relatively short length and is the sole fluid pressure conduit which is connected to said first and second lift cylinder means.

5. An upright structure as claimed in claims 1 or 2 wherein one of said telescopic upright sections includes an inner upright section on which is mounted said load carrier means, the support means of said first cylinder means being an upright section other than said inner upright section, and the support means of said second cylinder means being an upright section other than said inner upright section.

6. An upright structure as claimed in claim 2 wherein said first cylinder means first elevates said load carrier means relative to said plurality of retracted telescopic sections and said second cylinder means then operates to elevate said plurality of telescopic sections.

7. An upright structure as claimed in claim 6 wherein for a portion of the lifting cycle both said first and second cylinder means are operative simultaneously to elevate said load carrier means and said telescopic upright sections.

8. An upright structure as claimed in claim 7 wherein said simultaneous operation represents a dual lift transition between elevation of said load carrier means by said first cylinder means and elevation of said telescopic upright sections by said second cylinder means.

9. An upright structure as claimed in claim 7 wherein said first cylinder support means is located at a higher elevation than the location of said second cylinder support means.

10. An upright structure as claimed in claim 7 wherein during such simultaneous operation the load carrier means is elevated at substantially a 4:1 lifting ratio to the strokes of the first and second cylinder means.

11. An upright structure as claimed in claims 1 or 2 wherein the one ends of said first and second cylinder means are fixed in relation to each other and to said support means.

12. An upright structure as claimed in claim 11 wherein a fixed position hydraulic conduit connects said one ends of said first and second cylinder means.

13. An upright structure as claimed in claim 2 wherein first flexible lifting means connects said first cylinder means to said load carrier means for elevating the latter independently of said second cylinder means, and second flexible lifting means connects said second cylinder means to at least one of said plurality of telescopic sections.

14. An upright structure as claimed in claims 1 or 13 wherein said first and second flexible lifting means comprise chains reeved in the upright, said first chain being reeved first in a direction generally diagonal of the upright and then longitudinally of the upright.

15. An upright structure as claimed in claim 13 wherein said first flexible lifting element is secured at its one end adjacent one side of said first cylinder means and is secured at its opposite end substantially in the central vertical longitudinal plane of the upright.

16. An upright structure as claimed in claim 15 wherein said second flexible lifting means is secured at its one end to one of said plurality of telescopic sections substantially in the central vertical longitudinal plane of the upright.

17. An upright structure as claimed in claims 1 or 13 wherein said second flexible lifting means comprises a chain means reeved in the upright in a direction substantially transverse of the upright structure.

18. An upright structure as claimed in claim 13 wherein with the upright structure in a retracted condition the operator's normal visibility or line of vision through the central portion of the upright is generally unimpeded except by substantially a single width of flexible lifting element in the central vertical plane of the upright.

19. An upright structure as claimed in claim 13 wherein at least one of said cylinder assemblies is located a substantial distance toward one lateral side of the upright structure such that it projects at least partially into the area of interference by an adjacent vertical rail with the visibility of the operator from his normal line of sight through said adjacent vertical rail, said normal line of sight being defined when the operator is located in a predetermined designed position and attitude for normal operation of the lift truck, the operative connection of said cylinder assemblies and of said first and second flexible lifting means in the upright structure being such that at least approximately balanced lifting force-moments act upon the upright structure in transverse planes of the upright at least when a load is carried substantially centrally thereof.

20. An upright structure as claimed in claim 13 wherein said first flexible lifting means is reeved on first, second and third wheel elements connected respectively to said first cylinder means, to the lower end portion of one of said telescopic sections and to the upper end portion of the other of said telescopic sections.

21. An upright structure as claimed in claim 20 wherein the first and second wheel elements are mounted on a bias to a transverse plane of the upright and are located in substantial longitudinal rotating alignment for reeving said first flexible lifting means, and said third wheel element is mounted for rotation on a substantially transverse axis for connecting said first flexible means to said load carrier means, a twist coupling means being located in said first flexible lifting means.

22. An upright structure as claimed in claim 20 wherein said second flexible lifting means is reeved on a wheel means supported from one of said telescopic sections, said second flexible lifting means being connected at one end means to element means fixed in relation to said second cylinder means and at the opposite end means to the other of said telescopic sections.

23. An upright structure as claimed in claim 22 wherein the locations of said first and second cylinder means and of said plural wheel elements and means and flexible lifting means are in such relation to the upright structure and to each other that the force-moments in a transverse plane of the upright are in substantial balance.

24. An upright structure as claimed in claim 1 or 13 wherein a portion of said first flexible lifting means is reeved in the upright such that it is located at a distance from the central vertical plane of the upright which is approximately equal to twice the projected or transverse distance between the axis of said second cylinder means and the location of securement of one end of said second flexible lifting means.

25. An upright structure as claimed in claim 24 wherein said second flexible lifting means is secured to said second telescopic section in a transverse vertical plane thereof and is secured at its opposite end to a member which is fixed relative to said fixed upright section.

26. An upright structure as claimed in claim 13 wherein the vertical axis of a portion of said first flexible lifting means is spaced at a projected or transverse distance from the central vertical plane of the upright which is substantially equal to twice the projected or transverse distance between the vertical axis of said second cylinder means and the average of the sum of the projected or transverse distances thereof from certain secured ends of said second flexible lifting means.

27. An upright structure as claimed in claim 26 wherein said second flexible lifting means comprises two chain portions reeved in the upright in which said secured ends are fixed and wherein said opposite ends are secured to said second telescopic section at projected or transversely symmetrical locations on opposite sides of the central vertical plane of the upright.

28. An upright structure as claimed in claims 1 or 2 wherein the retracted height of said first cylinder means is equal substantially to one-half the retracted height of the upright structure and the retracted height of the second cylinder means is equal substantially to the height of the retracted upright structure.

29. An upright structure as claimed in claims 1 or 2 wherein one of said lift cylinder means projects at least partially into the longitudinal plane of one side of the upright.

30. An upright structure as claimed in claim 29 wherein said second cylinder means projects at least partially into the longitudinal plane of the opposite side of the upright.

31. An upright structure as claimed in claim 29 wherein said one cylinder means projects also into a transverse plane of the upright.

32. An upright structure as claimed in claims 1 or 2 wherein said first and second cylinder means are located substantial distances towards opposite lateral sides of the upright structure so that each said cylinder means projects at least partially into the area of interference by a respective adjacent vertical rail with the visibility of the operator from his normal line of sight through said respective adjacent vertical rail, said normal line of sight being defined when the operator is located in a predetermined designed position and attitude for normal operation of the lift truck.

33. An upright structure for lift trucks and the like having a fixed upright section, a first telescopic upright section mounted for elevation relative to said fixed section, a second telescopic upright section mounted for elevation relative to said first telescopic section and elevatable load carrier means mounted for elevation relative to said second telescopic section, the improvement comprising first and second lift cylinder means supported from a fixed base support means, first flexible lifting means operatively connecting said first cylinder means to said load carrier means for elevating said load carrier means on said second telescopic section independently of said second cylinder means, a plurality of wheel means operatively connecting said first cylinder means to said load carrier means and on which said first flexible lifting means is reeved, second flexible lifting means operatively connecting said second cylinder means to said first and second telescopic sections, a plurality of second wheel means operatively connected to said second cylinder means and on which said second flexible lifting means is reeved, said second flexible means being operatively connected from first end means fixedly secured relative to said second cylinder means at one end and secured at the opposite end to said second telescopic section and being adapted to elevate with said second cylinder means said first and second telescopic sections.

34. An upright structure as claimed in claim 33 wherein said first cylinder means is located in the central vertical longitudinal plane of the upright and said second cylinder means is located adjacent one side of the upright.

35. An upright structure as claimed in claim 33 wherein said second wheel means are supported from the upper end of said first telescopic section and said first wheel means include wheel elements rotatable both on axes substantially transverse of and longitudinal of the upright.

36. An upright structure as claimed in claim 35 wherein twist couplings are embodied in said first flexible lifting means at predetermined locations permitting a change in direction of said flexible lifting means between wheel means rotatable on said transverse and longitudinal axes.

37. An upright structure as claimed in claim 33 wherein a plurality of said second wheel means are mounted for rotation adjacent the top end of said first telescopic section, and said second flexible lifting means reeved thereon comprise first and second flexible lifting elements one of which is secured to said second telescopic section adjacent said second cylinder means and the other of which is secured to said second telescopic section at a location remote from said second cylinder means.

38. An upright structure as claimed in claim 37 wherein the opposite ends of each of said flexible lifting elements are fixedly secured adjacent opposite sides of said second cylinder means.

39. An upright structure as claimed in claim 37 wherein said second wheel means is located for rotation on a bias transverse of said upright.

40. An upright structure as claimed in claim 33 wherein the locations of said first and second cylinder means and of said plural wheel and flexible lifting means are in such relation to the upright structure and to each other that the force-moments in a transverse plane of the upright are in substantial balance.

* * * * *